United States Patent [19]

Erbach et al.

[11] 4,275,967

[45] Jun. 30, 1981

[54] METHOD FOR THE CONTINUOUS PRODUCTION OF EXPLOSIVE MIXTURES

[76] Inventors: Emil-Richard Erbach, Voiswinkeler Str. 45a, 506 Bergisch Gladbach 2; Max Klünsch, Bruchhauser Str. 57, 509 Leverkusen; Gerhard Lindner, Schillerstr. 4a, 5064 Rosrath; Paul Lingens, Kursiefener Str. 22, 5068 Odenthal, all of Fed. Rep. of Germany

[21] Appl. No.: 46,080

[22] Filed: Jun. 6, 1979

[30] Foreign Application Priority Data

Oct. 6, 1978 [DE] Fed. Rep. of Germany ..... 2825567

[51] Int. Cl.[3] ..... B01F 7/08; C06B 21/00

[52] U.S. Cl. ..... 366/149; 366/297

[58] Field of Search ..... 366/83–85, 366/149, 297, 300–301, 318

[56] References Cited

U.S. PATENT DOCUMENTS

| | | | |
|---|---|---|---|
| 3,576,675 | 4/1971 | Abramson et al. | 366/300 X |
| 3,983,862 | 10/1976 | Spriet | 366/301 X |
| 3,997,147 | 12/1976 | Scherping | 366/222 |
| 4,014,655 | 3/1977 | Brunnberg | 366/297 X |
| 4,194,842 | 3/1980 | Puthawala | 366/297 X |

*Primary Examiner*—Robert L. Bleutge

*Attorney, Agent, or Firm*—Sprung, Felfe, Horn, Lynch & Kramer

[57] ABSTRACT

A method for the continuous manufacture of explosive mixtures by mixing their components in screw mixers with at least one charging aperture. Proportioned amounts of the components of the mixture are brought into entry zones provided with screw elements and situated below the charging aperture. The mixture components are then advanced through alternation kneading zones and transport zones having screw elements to the output end. The transport and kneading zones are configured such that the shear gradient therein is between 20/sec and 1500/sec and the maximum pressure in the stream of the mass is not more than 100 bars.

5 Claims, 4 Drawing Figures

METHOD FOR THE CONTINUOUS PRODUCTION OF EXPLOSIVE MIXTURES

BACKGROUND OF THE INVENTION

The present invention relates to a method for the continuous preparation of explosive mixtures in dual screw mixers. The method makes it possible to mix the proportionally fed solid and liquid components uniformly with one another at varying temperatures and varying mixing and kneading intensities in successive transport and mixing zones within the mixer.

Up to the present time it has been the most common practice in the explosives industry to work components in apparatus operating batch-wise to form a very homogeneous mass. These apparatus are relatively large units having capacities of about 200 to 700 kilograms.

The mixing and kneading performed in the actual mixing and kneading apparatus is accomplished by means of mechanical devices operating on the mixing paddle or helical blade principle. Aside from the disastrous effects produced in the case of accidents that can be attributed to the great size of the batches, these mixing and kneading apparatus have one decided disadvantage. The design principles mentioned above have as a consequence that the mechanical devices always have a geometry designed for a particular purpose, and that geometry can not be changed. This means that different mixing and kneading apparatus have to be used for different explosives.

Furthermore, there are difficulties involved in producing a mixture of high homogeneity in batch apparatus. Therefore there exists in practice the danger of the formation of pockets of unmixed components.

It is for this reason that manufacturing methods or apparatus have been described for the continuous preparation of explosive mixtures using screw mixers (cf. U.S. Pat. No. 3,997,147, DE-OS No. 2,510,022 and DE-OS No. 2,515,492).

These known methods have common points to the extent that they perform the actual mixing and kneading process in a dual screw mixer which occasionally operates on the helical paddle mixer principle. Helical paddle mixers in a dual screw arrangement consist either of a continuous helical blade or of paddles in a helical array.

These types of helical mixers have decided disadvantages. The residence time range (residence time performance) of each model of machine is very narrow, and can be varied only by changing the rotatory speed. The latter, however, for reasons of safety, must not be too high. It is not possible, therefore, to change the detention time by any simple manipulation. The insertion of so-called baffles, or the use of progressively cut helices improves the mixing effect only slightly. On the relatively short course through the machine it is difficult to produce a mixture of great homogeneity, especially if gelatination and crosslinking is desired for a particular explosive mixture.

The components which are to be worked therefore undergo always a more or less constant stress on account of the virtually constant shear gradient resulting in poor variability of the shear forces. If these shear forces are additionally great for the purpose of achieving a sufficient mixing action in a relatively short machine length, then the hazard is increased to an undesirable extent, and gel structures already formed in the mixture can be torn apart again.

The previously mentioned narrow residence time range in conventional screw mixers has furthermore the disadvantage that fluctuations in the feeding of individual components can be compensated only to a slight extent, so that inhomogeneities can develop.

The problem therefore existed, in the continuous production of explosive mixtures in screw mixers, of avoiding the above-described disadvantages and being able to control the mixing process such that it can be used for explosive mixtures of differing composition, while obtaining mixtures of high homogeneity. Furthermore, the process must be able to be so conducted as to minimize the hazards.

SUMMARY OF THE INVENTION

This problem is solved by mixing the proportioned components together homogeneously and continuously in a screw mixer having transport and kneading zones of variously adjustable mixing or kneading intensity and temperature, disposed in variable succession.

The new method for the continuous production of explosive mixtures is therefore characterized by the fact that proportionally fed amounts of the components of the explosive mixture enter through charging apertures into the entrance zones which are provided with screw elements, and they are advanced from thence through kneading zones which are interrupted by transport zones equipped with screw elements, to the discharge end, the transport zones and kneading zones being adjustable as desired in sequence and configuration, and are furthermore so set up that in these zones there is a shear gradient between 20 per second and 1000 per second, and the maximum pressure in the mass stream does not exceed 100 bars.

The continuously operating screw mixer consists of two or more casing segments containing in their interior the transport and kneading zones. They are always joined by flanges to the next casing.

The most important feature of the present mixing and kneading process, in contrast to the mixing screws of uniform or progressive pitch used hitherto in the manufacture of explosives, is the successive use of screw elements and kneading elements of different pitch, length and number and selectable configuration, on the basis of a modular principle. It is desirable to dispose in the entrance zone transport screw elements of low kneading action, which feed the components to a kneading zone. If the screw mixer contains a plurality of charging apertures in tandem, several such entrance zones can be provided, each followed by a kneading zone. The kneading zone after the last charging zone is advantageously interrupted by one or more transport zones provided with feed screw elements.

This arrangement makes it possible to prevent backpressure from being exerted on the material being mixed and kneaded and to transport it continuously towards the discharge end of the machine.

In a preferred embodiment, two screw shafts situated parallel and side by side revolve in the same sense in the transport and kneading zones in casing sections which are hollowed out in a figure-eight configuration. It is possible, however, to have contrary rotation if the kneading and transport elements are shaped accordingly.

These screw shafts have key slots on which the individual screw and kneading elements, provided with appropriate springs, are mounted, so that they are simultaneously prevented from rotating. The elements are axially biased by screw threads in the front end of the screw shaft, so that no measurable clearances develop between the individual elements. The screw elements and kneading elements scrape against one another and the casing along a spherical curve with a close but adjustable clearance, thereby achieving a substantial self-cleaning action and eliminating dead spaces.

Both the screw elements and the kneading elements can be varied. The individual screw elements that can be mounted on the shafts can be varied with regard to pitch, pitch direction and length, while the kneading disk elements can be varied with regard to their offset and their length, according to the material that is to be mixed.

The explosive components are moved positively along the casing wall on a figure eight-shaped path. The screw elements situated between the kneading elements serve principally as a transport means by transporting the material to the next following kneading zone. The kneading elements can be installed as individual elements or in block form. The block form is preferred.

The present invention will be better understood from the following description and examples when read in conjunction with the accompanying drawings wherein:

DETAILED DESCRIPTION OF THE INVENTION

Figure 1:
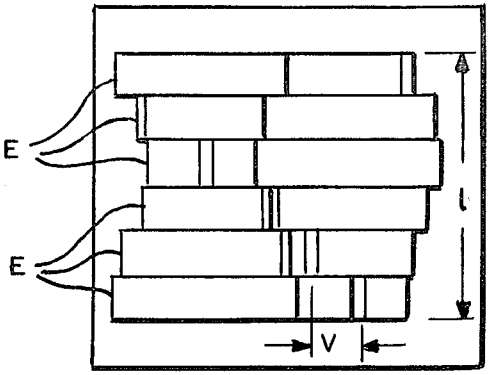
FIG. 1 is a top view of a kneading block according to the invention.

FIG. 1 is a top view of a kneading block, consisting of six kneading disk elements E, which are known in themselves, having a left offset V and the length l. The mirror image of this would be a kneading block with a right offset. Kneading blocks with right offset exercise a more gentle kneading action than those with left offset; they knead the material less intensely, and in addition have a back-pressure effect whereby the residence time of the material in the machine can be influenced.

Figure 2:
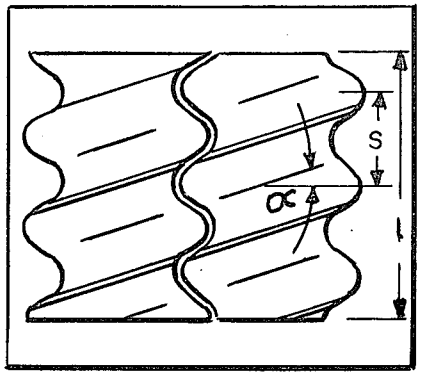
FIG. 2 is a top view of a feedscrew element according to the invention.

FIG. 2 shows a feed screw element of a particular pitch S, a pitch angle $\alpha$ and a length l. These three geometrical magnitudes are variable.

On account of the possibility of varying the spatial arrangement of the elements, their number, their pitch direction and their offset angle, the desired kneading intensity as well as the residence time of the material in the machine can be adjusted precisely within certain limits. The average residence time can be varied between 20 and 600 seconds, depending on the type of explosive, the screw configuration, the rotatory speed and the size of the machine.

Since additionally the circumferential speed can be varied by varying the rotatory speed of the drive, it is possible in connection with the selectable gap between the screw element or kneading element and the inner wall of the casing to determine the shear gradient that occurs. In accordance with the invention, the shear gradient is to be between 20/sec and 1500/sec, preferably between 100/sec and 800/sec.

Within the above named shear gradient and pressure ranges, the process can thus be adapted to each individual case by varying the screw element and kneading element operation, and, because of the fact that such operation can be determined in advance, the process can furthermore be rendered very safe.

The pressures that occur, as measured in the stream of the material, and particularly in the area of most intense stress, are not to exceed 100 bars. The pressure range between 1 and 25 bars proves to be especially advantageous in accordance with the invention.

In the manufacture of explosive mixtures involving the use of liquid nitric acid esters in mixing and kneading machines of any kind, they must not be able to penetrate into the interstices between the elements and the casing. This problem is solved in accordance with the invention in that the individual screw elements and kneading elements are cemented together after determining the configuration most suited to the particular explosive mixture involved, so that there are no interstices present. The same is the case with the individual casing segments. Care must be taken to see that the cement used is compatible with explosives and that it is insoluble in the liquid components of the explosive mixture.

The individual transport zones and kneading zones are preferably each surrounded by individual casings, although one casing can also extend over several zones or can cover only portions of individual zones.

These segmented casings can furthermore be jacketed, so that each casing can be individually cooled or heated. This selective temperature control over the entire length of the machine in accordance with the invention presents an additional great advantage over conventional screw mixers for the production of explosive mixtures. In this manner it is made possible, in conjunction with the mixing system and kneading system, in an especially advantageous manner, to dissolve solids in a liquid, for example, or to produce a gel.

The casing segments have between the flanges, apertures above which proportioning means can be disposed. This method of variation has the advantage that the components are delivered precisely to the mixing and kneading process at the optimum points, depending on the explosive mixture. For example, in this manner components are saved from having to pass unnecessarily through the full length of the mixer, thereby being exposed to undesirable mechanical or thermal stress.

In addition, holes can be tapped in the individual casings, in the flanges for example, so that temperature and pressure sensors can be screwed into them. The data produced by these instruments can be transmitted to the control station of the plant for digital or analog read-out or they can be recorded by graphic recorders or dot printers. The working values to be maintained can be assured by means of limits, so that when these limits are reached acoustical or optical signals are produced and the entire plant is shut down.

The tapped holes can also be used for inserting pipe and tube connections. This makes it possible to inject air or inert gas in a precisely controlled manner into the necessary mixing and kneading zone in any desired housing, thereby controlling, for example, the density of an explosive mixture. The air or the inert gas is derived for this purpose either from a stationary supply unit or from a main supply line, and can be adjusted to the necessary injection pressure in a conventional manner by means of pressure reducing valves having a fine adjustment. An additional gain from the safety viewpoint is achieved in accordance with the invention by various combinations of materials. For example, casings can be made from stainless steel and the elements of special bronze. Feeding and kneading elements made from plastics, such as polyamides, with and without glass fiber reinforcement, have been successfully used. The making of the casing sections of plastic, again with or without glass fiber reinforcement, is possible in accordance with the invention, provided the required temperatures are not close to the softening point of the plastic.

The proportioning of the different solid components is accomplished by means of continuously operating weighing systems, such as electronically controlled conveyor belt weigh scales or differential scales of known construction. The process makes it possible to feed the individual components through individual proportioning means into the mixing process, and also to prepare premixes of different components and then proportion them into the process. Which type of proportioning is to be given preference will depend on the nature of the components and the economy of the process. The proportioning of the liquid components, if they are relatively safe to handle, is performed by means of proportioning pumps operating on the basis, for example, of the piston principle, the rotary valve piston principle or a membrane pump.

Hazardous liquids, such as nitric acid esters, for example, are preferably proportioned according to the principle of level control with overflow.

The proportioning units for liquids and solids can be electrically interlocked with one another. The electrical interlocking is so designed that, in automatic operation, the proportioning apparatus can operate only if the mixing and kneading machine is running. If trouble occurs in this machine or in one of the proportioning apparatus, the entire plant is automatically shut down. Thus a maximum of safety is assured. The proportioning program can be so constructed that a proportioning apparatus assumes the control function. This means that, in the case of a deviation from the preset value in this apparatus, all other proportioning apparatus will likewise change in relation to this deviation. In this manner, the explosive mixture can be made to remain constant in its composition within the technically achievable proportioning accuracy. The feeding sequence as well as the timing in the start-up phase are programmed, and in this case they are controlled by a computer. A manual control that is also on hand makes it possible to operate the installation manually and thus to check out an explosive mixture or observe the effect produced by changing individual parameters.

In accordance with the method of the invention, it is especially advantageous to cartridge the explosive mixture directly upon its emergence from the screw mixer by coupling the machine to a synchronously operating cartridging apparatus. The cartridging can be performed by packing the explosive either in paper wrappers or in endless tubes which are then clipped off or sealed off to form cartridges of the desired length.

The nature of the cartridging apparatus is not subject matter of the invention. Any design known to the person skilled in the art can be used.

The cartridging can also be performed at a later time if it seems desirable to let the explosive "cure" by standing, i.e., to wait for any further crosslinking to take place. In this case, the explosive mixture is packed in containers which are later emptied into the cartridging apparatus. The explosive mixture, however, can also be packed in containers or plastic bags after it emerges from the mixing and kneading machine.

The method of the invention can be employed in the production of a great number of explosive mixtures of solid components and components which are liquid during the mixing. The method additionally advantageously makes it possible to include in the passage through the mixer dissolving processes, gelatinizing or impregnating processes, and chemical crosslinking.

Explosive mixtures for whose preparation the method of the invention is especially suited can be, for example, the following:

1. Explosives in powder form, i.e., mixtures of crystalline oxygen carriers and, in some cases, solid or liquid explosives with combustible components as well as other additives to improve moisture resistance or prevent caking in storage or safety against firedamp.

2. Gelatinous explosives on the basis of a gelatine of liquid, explosive nitric acid esters and nitrocellulose, in some cases also containing aromatic nitro compounds, mixed with crystalline oxygen carriers, solid or liquid combustible components, and other additives to produce, for example, an identifying coloration or to increase safety against firedamp.

3. Plastic explosives, such as mixtures of solid explosives of high shattering power, such as hexogen or pentaerythritol tetranitrate, with a binding agent.

4. Explosive slurries, i.e., mud-like mixtures of a liquid phase—usually highly concentrated aqueous solutions of ammonium nitrate and other alkali or alkaline earth nitrates thickened with swelling agents—with additional, oxygen-yielding salts, and combustible components such as, for example, aluminum powder, wood flour, also explosives if desired, such as trinitrotoluene, pentaerythritol tetranitrate, hexogen, and any other additives for influencing thickness or improving safety against firedamp.

This listing is not to be considered restrictive.

In many slurry explosives, detonatability is closely related to the presence of incorporated air bubbles. Sufficient sensitivity is obtained when the density of the mixture is reduced by incorporated air bubbles to about 1.0 to 1.4 g/cm$^3$, preferably 1.1 to 1.3 g/cm$^3$. In the method of the invention, this incorporation of air and the reduction of density produced thereby can be accomplished advantageously by establishing a suitable degree of filling by coordinating the screw speed and the rate of transport. Another possibility is to feed compressed air into the mixture at a suitable point.

EXAMPLES

Figure 3:
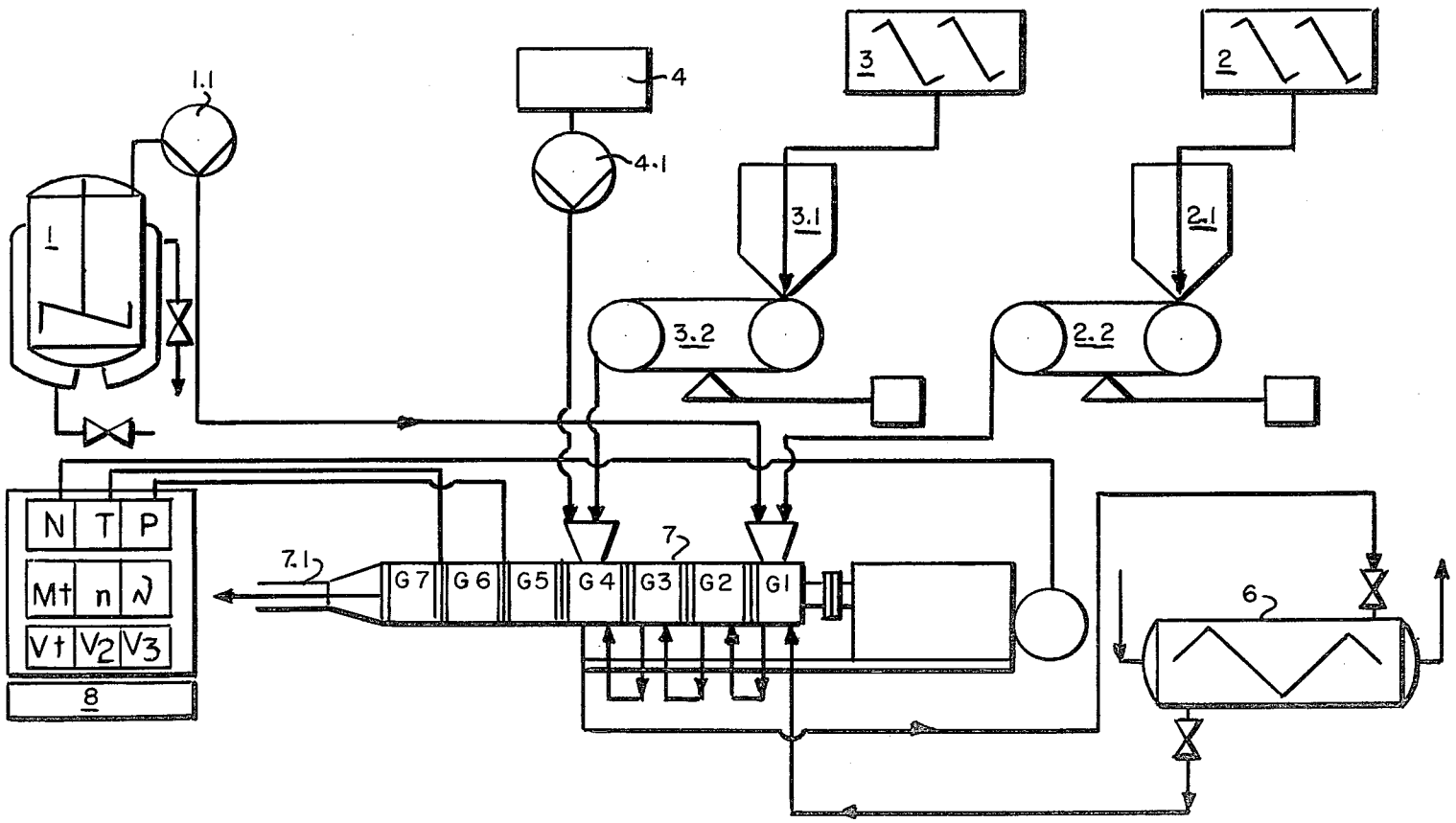
FIG. 3 is a schematic representation of one embodiment of the present invention.

Preparation of a slurry explosive permissible for use in mining (see FIG. 3).

The following were prepared:

| | | |
|---|---|---|
| Premix 1 | 1760 | g of ammonium nitrate |
| (liquid phase) | 4427 | g of methyl ammonium nitrate |
| | 1173 | g of urea |
| | 533 | g of sodium perchlorate |
| | 533 | g of water |
| Premix 2 | 1333 | g of sodium chloride |
| | 133 | g of hydroxypropyl guar as swelling agent. |
| Premix 3 | 12981 | g of ammonium nitrate |
| | 2667 | g of sodium chloride |
| | 267 | g of sodium perchlorate |
| | 533 | g of potassium nitrate |

-continued

| | |
|---|---|
| | 267 g of silica |
| Crosslinking agent | 5 g of potassium dichromate |
| | 53 g of water |

Premix 1 (liquid phase) of the above composition was prepared and blended in the stirring tank 1, while the temperature was maintained at 70° C. This hot liquid phase was fed through the proportioning pump 1.1 into the casing G1 of the dual screw mixer 7. The feeding pump was so adjusted that 422 g of the mixture were fed to the mixer per minute.

The components of Premix 2 were mixed together in the batch mixer 2 which discharges into the hopper 2.1. From the latter the premix was continuously removed by the conveyor belt weigh scale 2.2, and also proportioned into the casing G1 of the dual screw mixer 7. The conveyor belt weigh scale was adjusted to feed 73 grams per minute.

The casings G1 to G4 of the dual screw mixer 7 were heated at 70° C. with hot water from the water heater 6.

Figure 4:
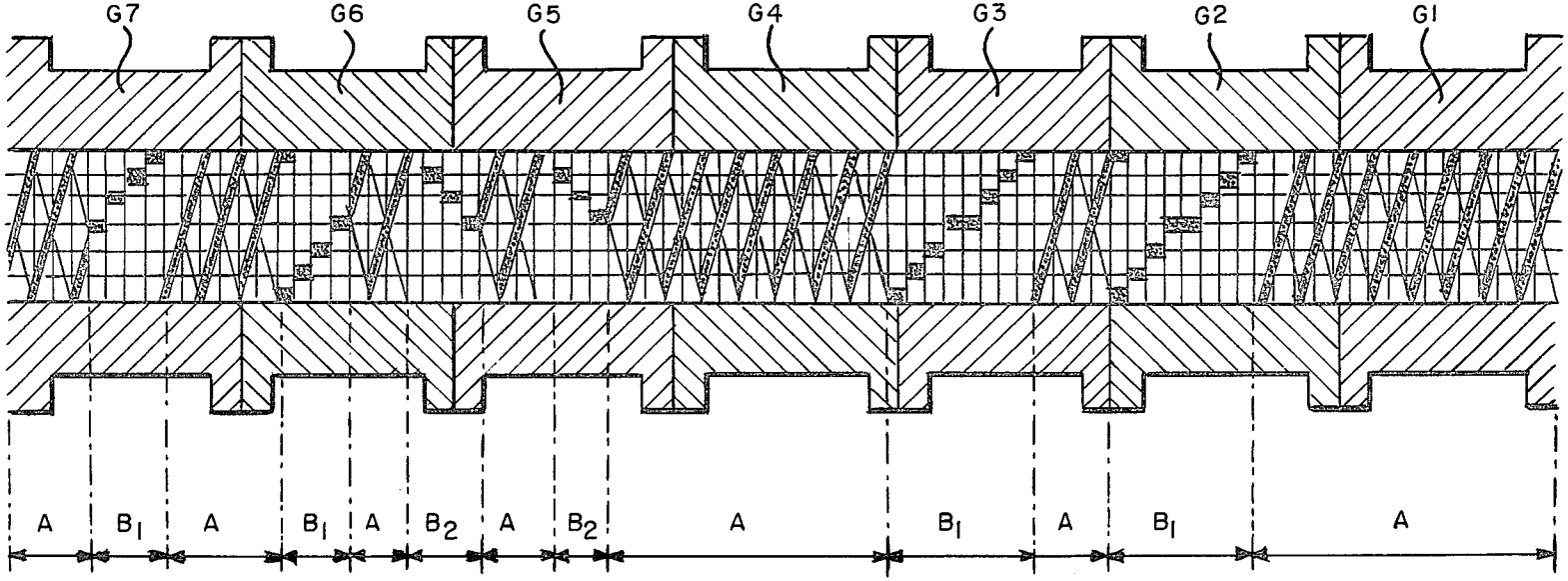
FIG. 4 is a schematic representation of a cross section view of the screw mixer of FIG. 3.

The two premixes 1 and 2 passed through the heated transport and kneading zones as represented in FIG. 4. The gelatination of the liquid phase took place in this passage. In FIG. 4, A represents the transport zone, B the kneading zones and G1 to G7 the casing around the individual zones. The kneading zones B1 have a left offset while kneading zones B2 have a right offset.

The components of Premix 3 were premixed in batch mixer 3 and discharged into hopper 3.1. From the latter they were continuously withdrawn by the conveyor belt weigh scale at a rate of 836 g/min and proportioned into the dual screw mixer 7 through the inlet opening in the heated casing G4. The area below the charging apertures at G1 and G4 define entry zones including the screw elements associated therewith.

The crosslinking agent from supply tank 4 was fed by the proportioning pump 4.1 to casing G4 of the dual screw mixer 7. The proportioning was adjusted such that 2.9 grams were fed per minute to the dual screw mixer.

The transport zone that is in this input section (see FIG. 4) extended to the middle of casing G5 and this counteracted any backpressure effects from the kneading zones that followed. This transport zone was then followed in casings G5 to G7 by transport zones and kneading zones of different mixing and kneading intensity. Casings G5 to G7 were cooled down to 15° C. with cold water.

An intense mixing and kneading of the solids of Premix 3 with the previously gelatinized liquid phase took place in casings G4 to G7. At the same time a further solidification of the gelatines was brought about in these zones by the added crosslinking agents.

At 7.1 in FIG. 3 there is a cartridging apparatus. A flexible plastic tube three meters long and 30 mm in diameter was drawn over the cartridge forming tube in the present example. This tube was continuously filled by the emerging stream of the composition and was made into tubular cartridges 20 cm long by binding off in a known manner.

The experiment was stopped after a working period of 20 minutes. The rate of throughput in the dual screw mixer was 80 kilograms per hour. All of the technical data of the process were supervised at the control desk 8 in FIG. 3 of an operating station situated in an armored cabin at the required safe distance. Also installed in the desk were monitors for the direct obervation of the experiment through TV cameras. In the present example the following measurements were recorded:

| | |
|---|---|
| Motor power: | N = 1.8 kW (13 kW installed power) |
| Rotatory speed: | n = 120 $min^{-1}$ |
| Shear gradient: | $\Theta$ = 364 $^1$/sec |
| Torque: | $M_t$ = 15–16% of permissible maximum |
| Mass pressure: | P = 1.5 bars at input to cartridging apparatus |
| Substance temperature: | T = 20° C. (measured at discharge) |
| Mass stream: | $V_1$ = 25.620 kg/h (liquid phase = Premix 1) |
| Mass stream: | $V_2$ = 6.880 kg/h (Premix 2) |
| Mass stream: | $V_3$ = 47.500 kg/h (Premix 3) |

The explosive mixture obtained had the following characteristics:

Density: 1.1 to 1.2 g/$cm^3$

Trauzl lead block expansion: 240 ml/dag

Detonation velocity: V=3400 m/s (unconfined)

Alternatively to the above-described procedure, the following variants, given by way of example, are possible.

1. Starting with a pre-gelatinized liquid phase (Premix 1)

In this case the gelatination in the front portion of the machine, casings G1–G3, is omitted, and the machine is not heated, therefore. Since all that is involved now is an intense mixing and kneading process, it can be performed with a shortened machine. This alternative was performed with transport and kneading zones G4 to G7 of the casing in FIG. 3, i.e., casings G1 to G3 ran empty, and the liquid phase and Premix 3 were fed in at the entry casing G4.

2. Simultaneous production and gelatination of a liquid phase

For this purpose the dual screw mixer 7 was required in its full length, including casings G1 to G7. The feeding of the materials was modified in that a solution of methyl ammonium nitrate and water at 70° C. was placed in the stirring tank 1 of FIG. 3, and was delivered by means of the proportioning pump 1.1 to casing G1 of the dual screw mixer 7. The components of Premix 1 were premixed together with those of Premix 2 in the batch mixer 2 and were also proportioned into the casing G1 of the dual screw mixer 7 through the hopper 2.1 and the conveyor belt weigh scale 2.2.

Otherwise the process was performed as in Example 1.

EXAMPLE 2

Production of an explosive in powder form (see FIGS. 3 and 4)

Two premixes were prepared with the following amounts:

Premix 1

4667 g of trinitrotoluene 667 g of technical isomer mixture of dinitrotoluene and dinitroxylene Premix 2

27217 g of ammonium nitrate 667 g of wood flour 50 g of hydrate of alumina 50 g of iron oxide red.

The process was performed in principle as represented in FIG. 3 with the following changes: mixer 3 and 4 and their corresponding proportioning and feeding systems were eliminated. The proportioning pump 1.1 was in this case a flexible tube proportioning pump.

In the stirring tank 1, Premix 1 was liquefied by heating at 80° C. and fed in by pump 1.1 into the casing G1 of the dual screw mixer 7. The rate of feed was so adjusted that 267 grams were delivered per minute.

The components of Premix 2 were premixed in the batch mixer 2, emptied into the supply hopper 2.1 and withdrawn from the latter continuously at a rate of 1400 g/min by the conveyor belt weigh scale 2.2, and also fed into casing G1.

Casings G1 and G2 are likewise heated at 80° C. Upon passing through the feeding and kneading zones of this casing, the solids of Premix 2 were intensely mixed with the liquefied components of Premix 1. In the following cooled casings G5 to G7 of the dual screw mixer 7, a further intense mixing and kneading were performed, so that at the end of the machine an explosive mixture of a powdery consistency emerged. After 20 minutes of running time the experiment was ended.

The explosive mixture obtained had the following characteristics:

Density: 0.95 g/cm$^3$

Trauzl lead block expansion: 380 ml/dag

Detonation velocity: $V_1$=4000 m/s confined $V_2$=2500 m/s unconfined

The rate of throughput in the dual screw mixer was Q=100 kg/h.

The technical process data were determined as follows:

| | |
|---|---|
| Motor power: | N = 3 kW (installed power 13 kW) |
| Rotatory speed: | n = 100 min$^{-1}$ |
| Shear gradient: | $\Theta$ = 303 $^1$/sec |
| Torque: | $M_t$ = 50% of permissible maximum |
| Mass pressure: | P = 2 bars measured at casing 7 |
| Mass flow: | $V_1$ = 16 kg/h |
| Mass flow: | $V_2$ = 84 kg/h |
| Substance temperature: | T = 22° C. (measured at discharge) |

Although embodiments and examples of the invention have been described with reference to the accompanying drawings, it is to be understood that the invention is not limited to those embodiments or examples and that various changes and modifications can be made by one skilled in the art without departing from the scope or spirit of the invention.

What is claimed is:

1. In a method for the continuous manufacture of explosive mixtures by mixing their components in screw mixers with at least one charging aperture, the improvement comprising: bringing proportioned amounts of the components of the mixture into entry zones provided with screw elements and situated beneath the charging aperture and advancing the mixture components through kneading zones which are interupted by transport zones having screw elements, to the output end, the transport and kneading zones being selectively adjusted in sequence and configuration and being furthermore adjusted such that in these zones a shear gradient between 20/sec and 1500/sec is present and the maximum pressure in the stream of the mass is not more than 100 bars.

2. Method of claim 1, wherein the shear gradient in the transport and kneading zones is between 100/sec and 800/sec.

3. Method of claim 1, wherein the explosive mixture passes through transport and kneading zones having two screw shafts or kneading shafts situated parallel and side by side, on which screw segments and kneading disks, respectively, are fixedly mounted, and which are surrounded by external casings having a figure-eight shaped internal cross section.

4. Method of claim 1, 2 or 3, further comprising heating the explosive mixture in at least one zone during its passage through the transport and kneading zones.

5. Method of claim 1, 2 or 3, further comprising cooling the explosive mixture in at least one zone during its passage through the transport and kneading zones.

* * * * *

UNITED STATES PATENT AND TRADEMARK OFFICE

CERTIFICATE OF CORRECTION

PATENT NO. : 4,275,967

DATED : June 30, 1981

INVENTOR(S) : Emil-Richard Erbach et al

It is certified that error appears in the above-identified patent and that said Letters Patent are hereby corrected as shown below:

Title Page Priority Date delete "October 6," insert --June 10,--.

Signed and Sealed this

*Tenth* Day of *November 1981*

[SEAL]

*Attest:*

GERALD J. MOSSINGHOFF

*Attesting Officer*

*Commissioner of Patents and Trademarks*